US007096513B1

(12) United States Patent
Kress

(10) Patent No.: US 7,096,513 B1
(45) Date of Patent: Aug. 29, 2006

(54) PROTECTIVE HELMET WITH EMERGENCY REMOVAL FEATURE

(76) Inventor: James R. Kress, 11608 W. Greene Rd., Waterford, PA (US) 16441

( * ) Notice: Subject to any disclaimer, the term of this patent is extended or adjusted under 35 U.S.C. 154(b) by 0 days.

(21) Appl. No.: 11/271,262

(22) Filed: Nov. 10, 2005

(51) Int. Cl.
*A42B 1/06* (2006.01)

(52) U.S. Cl. ..... 2/410; 2/425

(58) Field of Classification Search ..... 2/411, 2/424, 425, 410, 422
See application file for complete search history.

(56) References Cited

U.S. PATENT DOCUMENTS 4,665,569 A * 5/1987 Santini ..... 2/425
4,955,089 A * 9/1990 Beale ..... 2/410
6,108,824 A 8/2000 Fournier et al.
6,138,283 A * 10/2000 Kress ..... 2/411
6,418,564 B1 * 7/2002 Sheridan ..... 2/425
6,892,400 B1 5/2005 Choi et al.

FOREIGN PATENT DOCUMENTS

DE 3727701 A1 * 3/1989

* cited by examiner

*Primary Examiner*—Rodney M. Lindsey
(74) *Attorney, Agent, or Firm*—Carothers and Carothers

(57) ABSTRACT

A multi-piece helmet for protecting the head region of a wearer and providing emergency removal wherein the helmet shell is provided in separate front and rear portions along a seam. A securing mechanism extends between the helmet portions and holds them together in a releaseable manner. The securing mechanism is positioned on the interior surfaces of the helmet shell and finger access ports are provided in the helmet for providing finger access to the securing mechanism from exterior surfaces of the helmet whereby the securing mechanism may be finger manipulated for thereby releasing the securing mechanism and completely separating the front helmet shell portion from the rear helmet shell portion without requirement of a tool.

5 Claims, 17 Drawing Sheets

PROTECTIVE HELMET WITH EMERGENCY REMOVAL FEATURE

BACKGROUND OF THE INVENTION

The present invention pertains to improvements in protective headgear. More particularly, the present invention is directed to a helmet which can be removed in an emergency situation without excessive movement of the wearer's head to avoid exacerbating possible head, neck or spinal injuries.

Protective headgear is worn by various athletes including, but not limited to, football players, race car drivers, motorcyclists, bikers, hockey players, skateboarders, and ski racers. In spite of efforts to protect the head of the wearer, occasionally a sports participant undergoes a head, neck or spinal injury. In such cases, it is extremely important that the head not be moved until the nature and extent of the injury can be diagnosed. Simultaneously, it is just as critical that the headgear be removed quickly should CPR be necessary and to enable the diagnosis to be carried out quickly so proper medical attention can be administered promptly. Conventional head gear requires the head of the wearer to be raised and an axial pull force, and associated frictional force, exerted to effect removal. Such movement of a patient's head is exactly the type of movement that could turn a relatively minor injury into a permanent disability or result in death.

The present invention provides a multiple-piece helmet design, the parts of which can be disassembled and removed from the head of its wearer while minimizing movement of the athlete's head and spinal column. The present invention pertains to improvements in the present inventor's helmet design disclosed in U.S. Pat. No. 6,138,283, issued on Oct. 31, 2004 for PROTECTIVE HELMET WITH MEDICAL EMERGENCY REMOVAL FEATURE.

The inventor's prior design, while being effective has certain shortcomings which the present invention overcomes. In the inventor's prior art design, all latching mechanisms were located on outside surfaces of the helmet shell, making them subject to contact by other players and exposure to the elements whereby accidental separation might occur. In addition, the inventor's prior art helmet required the use of a tool to gain access to the latching mechanisms. This requires that people attending the injured person must always carry the required tool with them and this further complicates and extends the time for effecting helmet separation as the tool must first be retrieved, if available, and then manipulated before access to helmet separation is even possible.

It is a principal object of the present invention to provide a multi-piece helmet which is devoid of these disadvantages and is further inexpensive to manufacture and maintain.

SUMMARY OF THE INVENTION

A multi-piece protective helmet of the present invention is comprised of a rigid rear helmet portion and a separate rigid front helmet portion which when combined provide a helmet shell. The helmet portions have interior and exterior surfaces and inter-protruding guide means or mechanisms for aligning the helmet portions together along a seam therebetween. A securing means or mechanism extends between the helmet portions and holds the portions together in a releaseable manner. The invention resides in the feature that the securing means or mechanism is positioned on the interior surfaces of the helmet shell and finger access ports are provided in the helmet for providing finger access to the securing means or mechanism from the exterior surfaces whereby the securing mechanism may be simply finger manipulated for thereby releasing the securing mechanism and completely separating the front helmet portion from the rear helmet portion without requirement of a tool. The finger access ports also provide additional ventilation to help cool the wearer's head and the interior latch mechanisms are fully protected from weather conditions, turf debris and player or other contact whereby accidental fouling and separation are prevented even with hard contact to the helmet. Since no tool is required, the person attending the injured player simply places his or her fingers in the finger access ports and thereby manipulates the securing means or mechanisms with one's fingers to thereby quickly release the securing mechanism and completely separate the front helmet portion from the rear helmet portion while always maintaining proper cervical alignment without causing hyper extension to the neck or spine of the injured person. The rear helmet portion can be taped to the injured person's head or cradled in a head support, if desired, to maintain bracing of the head while in transit to the hospital.

The securing means or mechanism includes in one embodiment, multiple snap-fit finger latches, wherein each latch has a flexible stem secured at a proximal end thereof to the interior surface of one of the helmet portions, and a latch tooth laterally protrudes from a distal end of each of the flexible stems. The latch teeth are respectively received in corresponding coapting latch recesses in the interior surface of the other of the helmet portions and the finger access ports are positioned in the helmet whereby the stems may be engaged through the respective ports from exterior surfaces of the helmet by ones fingers for thereby simultaneously flexing the stems to disengage the latch teeth from the respective latch recesses for thereby separating the front helmet portion from the rear helmet portion. This latch mechanism may include a displaceable safety lock which is positioned to block the flexible finger latch stems from flexing and thereby accidentally disengaging the latch mechanism.

The flexible stems of the snap-fit finger latches may be secured at their proximal ends to a respective base which in turn is detachably secured to interior surfaces of the helmet. In this configuration, if the latch mechanism is excessively worn or the finger latches are broken, the latch mechanism may be easily reconditioned or replaced by simply removing the entire unit base and securing a new base therein with latch fingers appended. This permits easy, inexpensive and fast reconditioning and manufacture, and further provides a securing mechanism which is adaptable to helmets of all sizes.

In another embodiment of the present invention, the helmet seam may have a castellated tooth configuration providing inter-engaging teeth therealong, and the afore-described latch recesses are provided in the interior surfaces of the castellated teeth.

In yet another embodiment of the present invention, the securing means or mechanism may include a rotatable latch mechanism having a securing protrusion which protrudes into a corresponding depression in the interior surfaces of the helmet whereby the latch mechanism is accessible from the exterior surfaces of the helmet for depression to thereby disengage said protrusion from said depression to thereby release the latch mechanism for rotation thereof by engagement through the finger access ports.

BRIEF DESCRIPTION OF THE DRAWINGS

The helmet shell in all drawing figures is shown without the addition of protective installation or padding applied to the interior surfaces of each half of the shell in order to better expose the features of the present invention.

Other objects and advantages appear hereinafter in the following description and claims. The appended drawings show, for the purpose of exemplification, without limiting the scope of the invention or appended claims, certain practical embodiments of the present invention wherein:

DETAILED DESCRIPTION OF THE PREFERRED EMBODIMENTS

Figure 1:
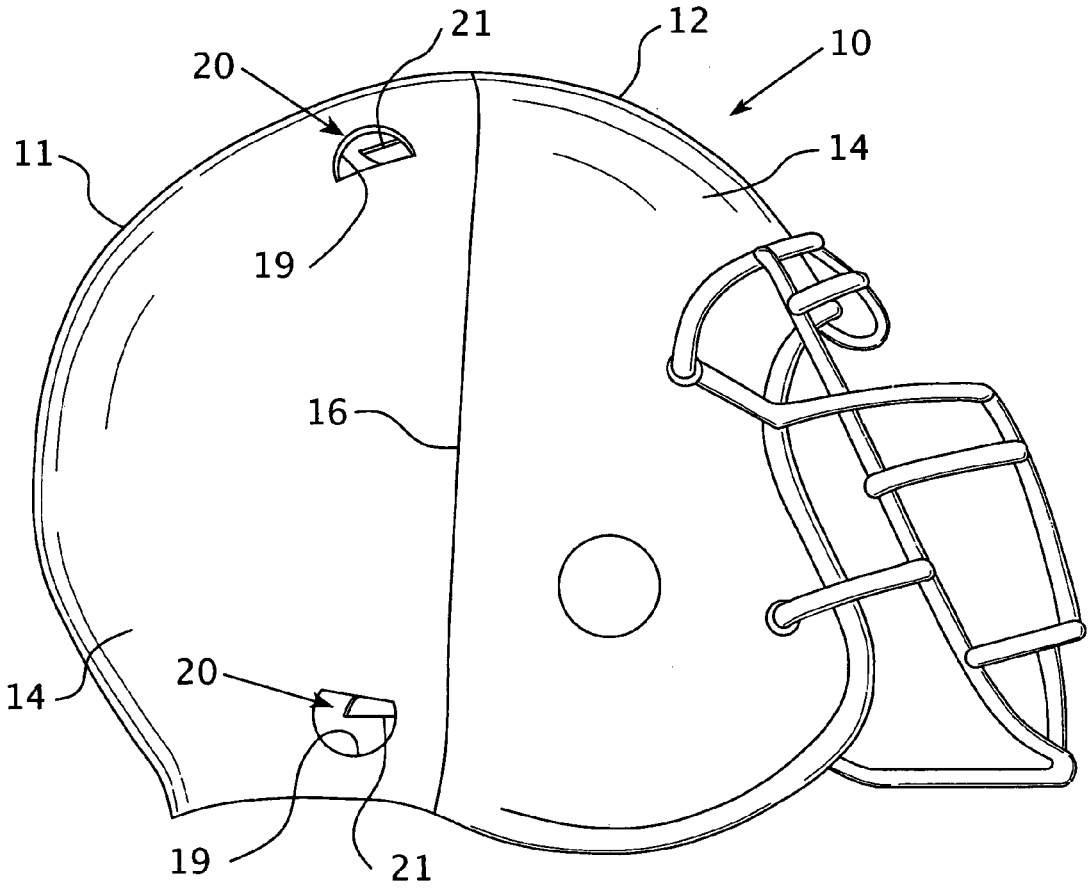
FIG. 1 is a side view of a first embodiment of the two-piece helmet of the present invention.
Figure 2:
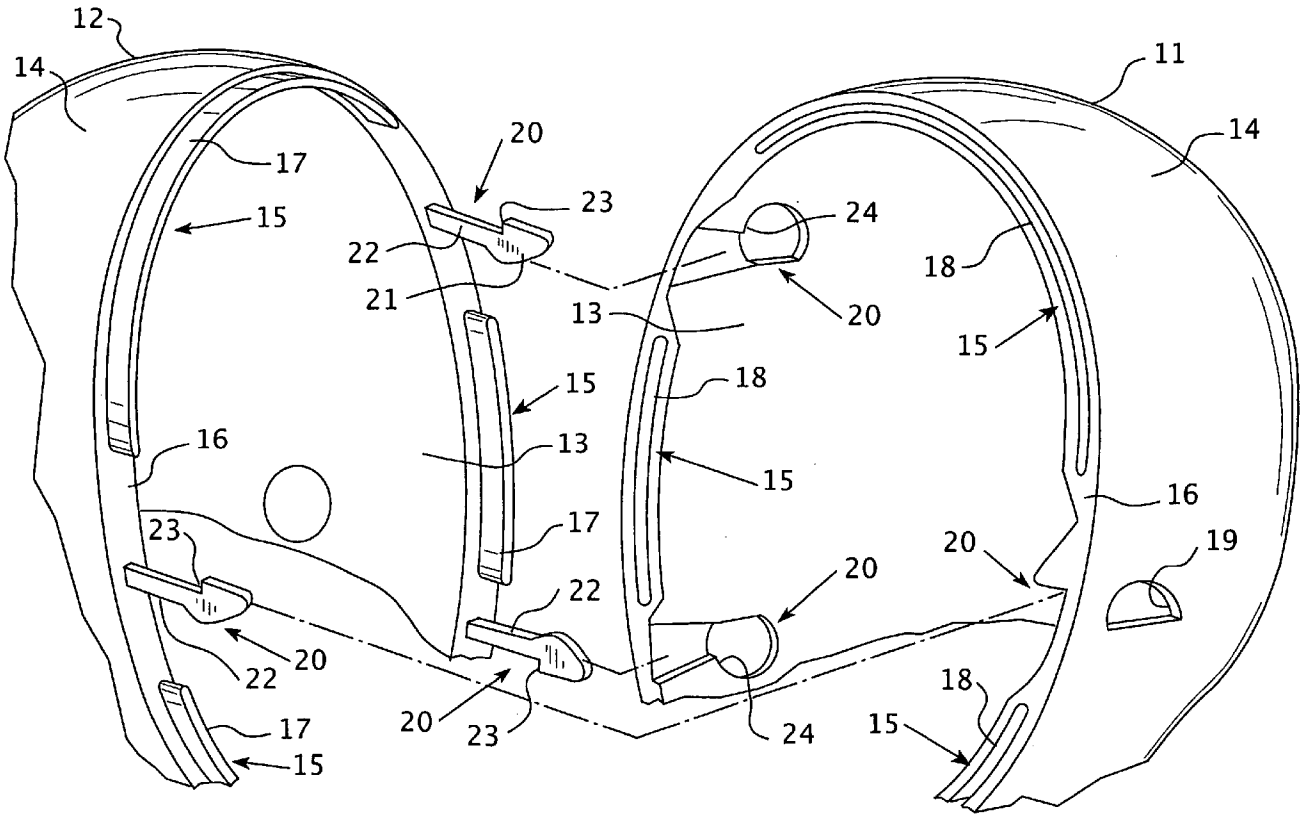
FIG. 2 is a perspective side view of the two-piece helmet shown in FIG. 1 as seen from the opposite side with the helmet pieces or portions disengaged for viewing interior portions thereof.
Figure 3:
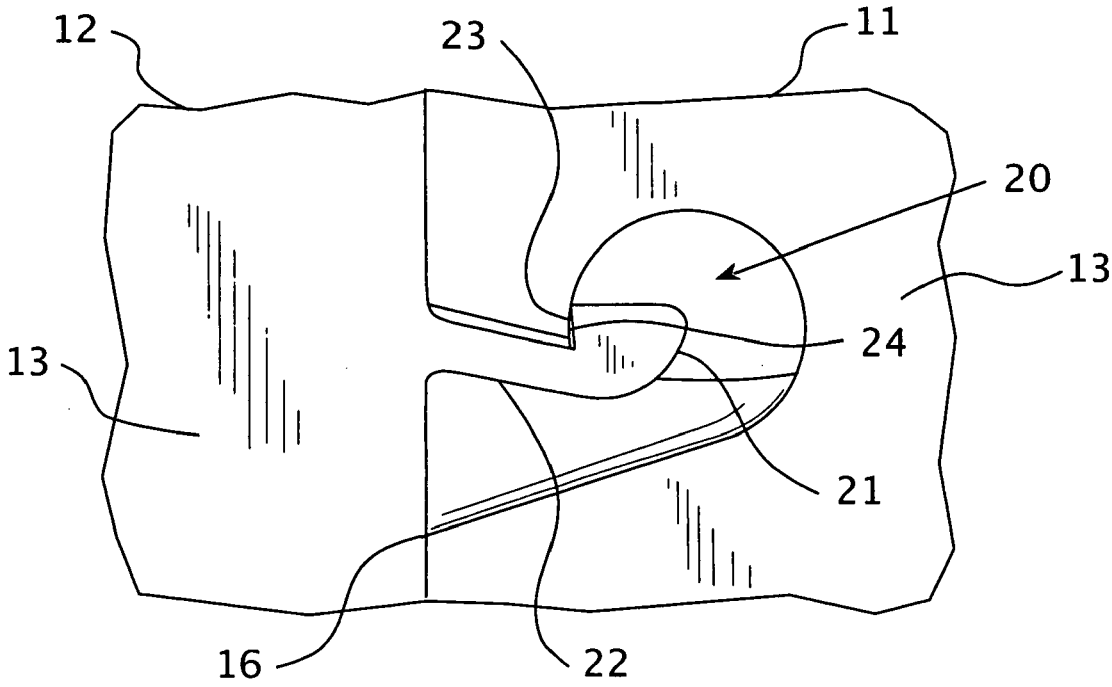
FIG. 3 is an enlarged interior view of the two-piece helmet of FIG. 1 showing one of the locking mechanisms or securing means securing the two helmet portions together.

Referring to FIGS. 1, 2 and 3, a first embodiment of the two-piece helmet of the present invention is illustrated. The helmet 10 is intended for protecting the head region of a wearer and provides emergency removal in the event of an injury. The helmet illustrated is designed for the sport of football. However, it must be remembered that the multi-piece helmet of the present invention applies to helmets used in all sports. Also, only the shell of the helmet 10 is shown in all the drawings without the conventional interior padding for clarity. In normal use a conventional layer of padding would be provided on the interior surface 13 of both helmet portions 11 and 12 and this shock insulation layer would also separate at seam 16.

The helmet 10 is provided in two pieces which may be separated, mainly a rigid rear helmet portion 11 and a separate rigid front helmet portion 12. As is best seen in FIG. 2, the helmet portions 11 and 12 have interior surfaces 13 and exterior surfaces 14 and inter-protruding guide means 15 for aligning helmet portions 11 and 12 together along the seam 16 therebetween. In this embodiment, the inter-protruding guide means 15 is comprised of protruding lips 17 in helmet portion 12 which are received in corresponding recesses 18 provided in helmet portion 11.

A securing means 20 extends between helmet portions 11 and 12 for holding portions 11 and 12 together in a releaseable manner. The securing means 20 is positioned on the interior surfaces 13 of the helmet 10 where they cannot be accidentally engaged to separate the helmet portions 11 and 12. In this illustrated embodiment, the securing means 20 consists of four separate latch mechanisms which must be simultaneously manipulated in order to disengage helmet portions 11 and 12.

Finger access ports 19 are provided in the helmet 10 for providing finger access to the securing means 20 from exterior surfaces 14 of helmet 10 whereby the securing means 20 may be finger manipulated simultaneously for thereby releasing the securing means 20 and completely separating the front helmet portion 12 from the rear helmet portion 11 without requirement of a tool. Once the front helmet portion 12 is disengaged, the rear helmet portion 11 may, if desired by the attendant, be taped to the head of the injured player so that the player's neck and spine are not hyper-extended, and the injured player may thus be delivered directly to emergency facilities for treatment.

In this embodiment the securing means 20 includes multiple snap-fit finger latch mechanisms 21 extending from the interior edges of front helmet portion 12 toward back helmet portion 11. Each of the snap-fit finger latch mechanisms 21 have a flexible stem 22. Each of the snap-fit finger latch mechanisms 21 also have a latch tooth 23 laterally protruding from the distal end of each of the stems 22 which is received in a corresponding coaptating latch recess 24 in the interior surfaces 13 of the other rear helmet portion 11. Ports 19 are positioned in rear helmet portion 11 whereby the finger latch 21 may be engaged through the respective ports 19 from the exterior surfaces 14 by ones fingers to thereby flex the stems 22, disengage latch teeth 23 from their respective latch recesses 24 for separating the front helmet portion 12 from the rear helmet portion 11.

In operation when a player or other person is injured, the attendant kneels at the head area of the injured person who is positioned or lying on his or her back. The attendant inserts his or her opposing forefinger and thumb of each hand into the finger access ports 19 of the helmet half 11 and simultaneously squeezes the latch mechanisms 21 on each side of the helmet together to thereby release the front portion 12 of the helmet.

Figure 4:
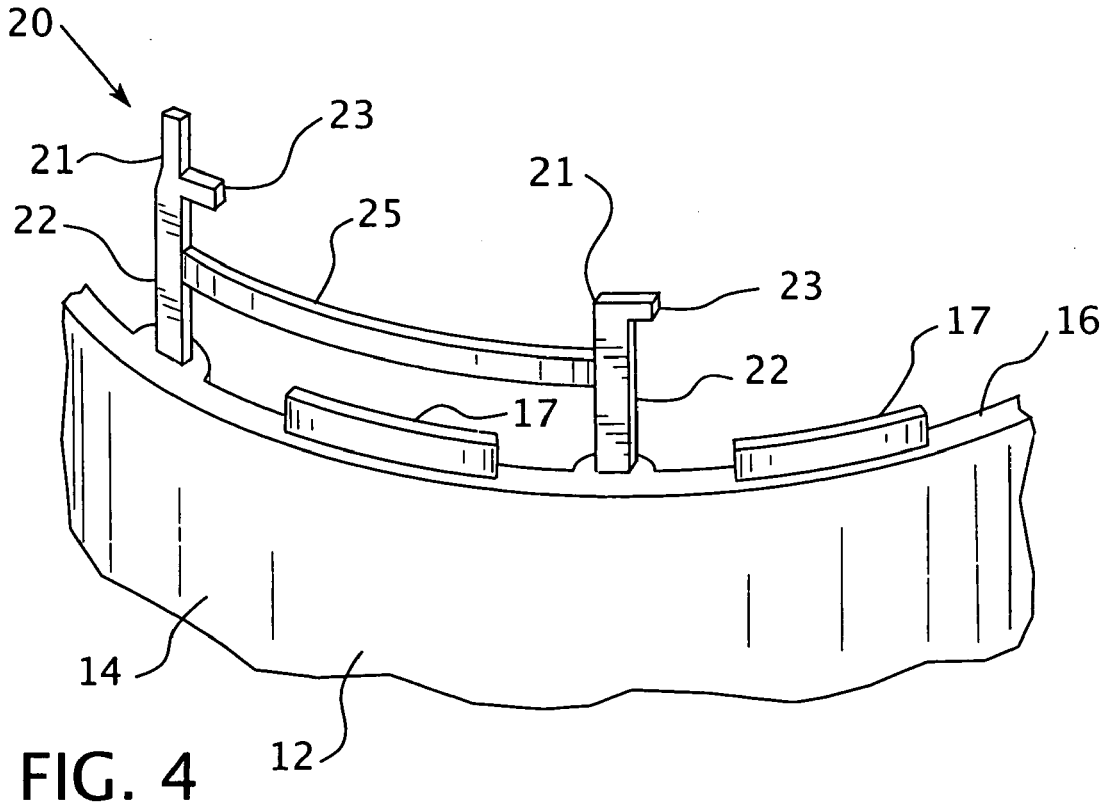
FIG. 4 is an enlarged perspective view showing a portion of one of the helmet portions in partial section illustrating another embodiment of the securing mechanism for securing the two helmet portions together.

Turning next to FIG. 4, another embodiment of the latch mechanism 21 is illustrated, which is a slight variation of that shown in FIGS. 1,2 and 3. In this embodiment, the two latch mechanisms 21 have their flexible stems 22 tied together on the same side of the front helmet portion 12 with a tie bar 25. Accordingly, when latch mechanism 21 as seen in the right hand side of the figure is flexed to the left to unlatch the same, in a fashion similar to that as described with the previous figures, the tie bar 25 simultaneously flexes the stem 22 of the left hand latch mechanism 21 in the same direction to also detach so that both latch mechanisms 21 detach simultaneously.

Figure 5:
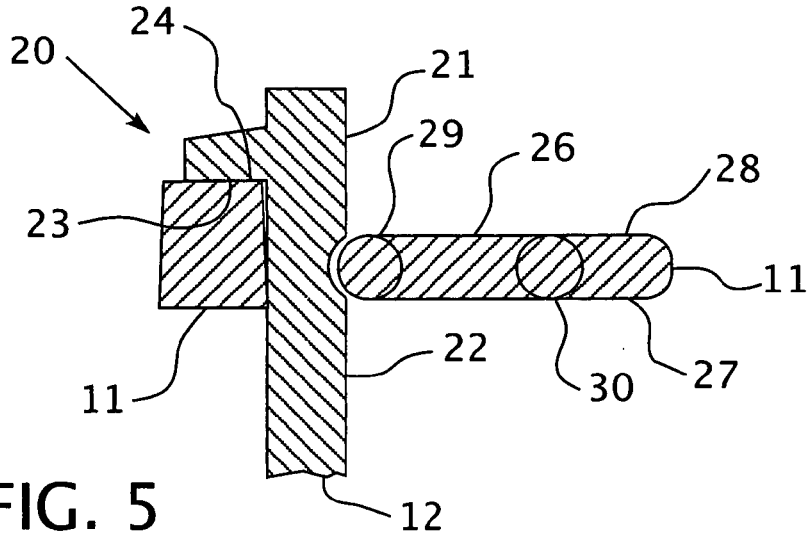
FIGS. 5, 6 and 7 are enlarged schematic representations illustrating the sequential operation of another embodiment of the latch mechanism or securing means securing the two helmet portions together.
Figure 6:
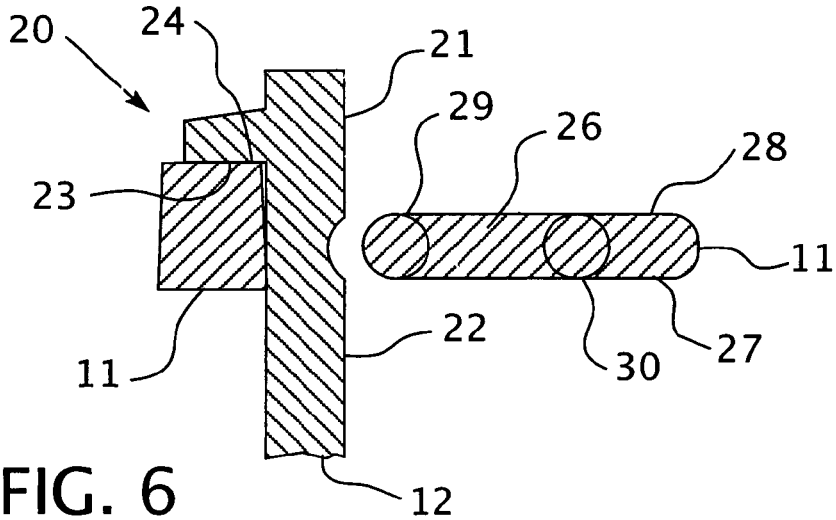
Figure 7:
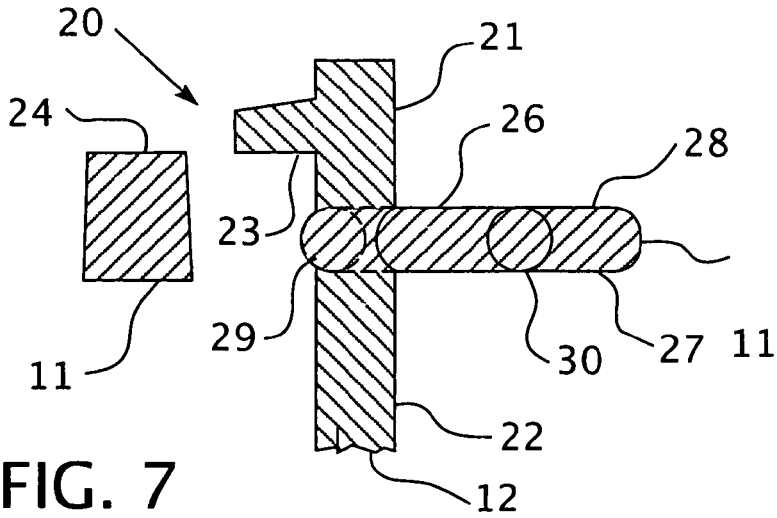

FIGS. 5,6 and 7 schematically represent latch mechanism 21 of the type previously shown in FIGS. 1,2 and 3. However, in this embodiment a secondary keeper latch 26 is provided as a failsafe feature for preventing latch mechanisms 21 from becoming accidentally dislodged or disengaged.

Secondary keeper latch 26 is provided with a flexible stem 27 which is connected at its proximal base end 28 to the interior portions of helmet portion 11 for flexing therefrom. Keeper 26 in FIG. 5 is shown in its relaxed position. In FIG. 6 keeper latch 26 is flexed downwardly so that the upwardly extending pin 29 is disengaged from flexible stem 22 of latch mechanism 21. This flexing of keeper 26 is accomplished by depressing button 30 downwardly or inwardly to flex stem 27 also downwardly and inwardly. Button 30 is accessed through the finger port from the exterior portions of the helmet as is the case also with the embodiment of FIGS. 1 through 3.

Once the failsafe secondary keeper latch 26 has been depressed downwardly out of the way, then latch mechanism 21 may be depressed through the same or another finger access port to the right as illustrated in FIG. 7 so that the helmet halves 11 and 12 may be separated. FIG. 5 shows the latch mechanism with both the latch mechanism 21 and the failsafe secondary keeper latch 26 relaxed in a normally closed position and the helmet halves 11 and 12 are firmly secured together.

Figure 8:
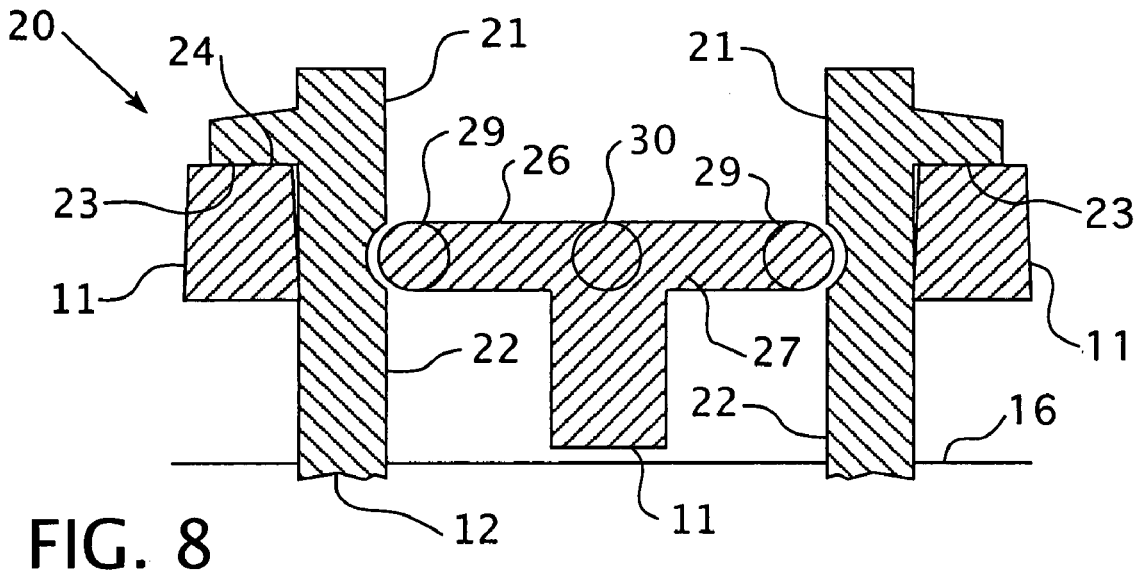
FIGS. 8, 9 and 10 are enlarged schematic representations illustrating yet another embodiment of the type of latching mechanism or securing means shown in FIGS. 5, 6 and 7.
Figure 9:
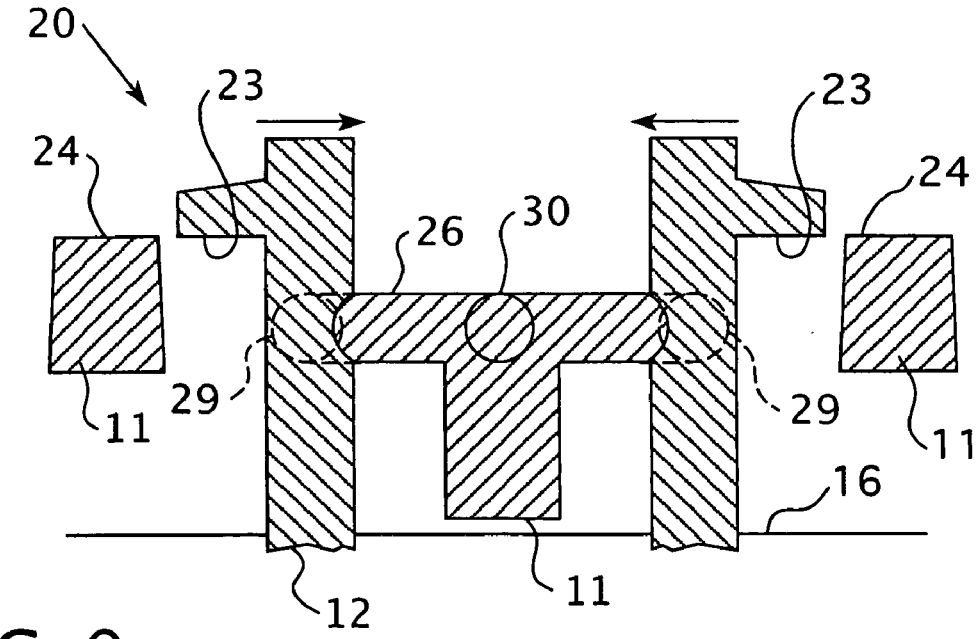
Figure 10:
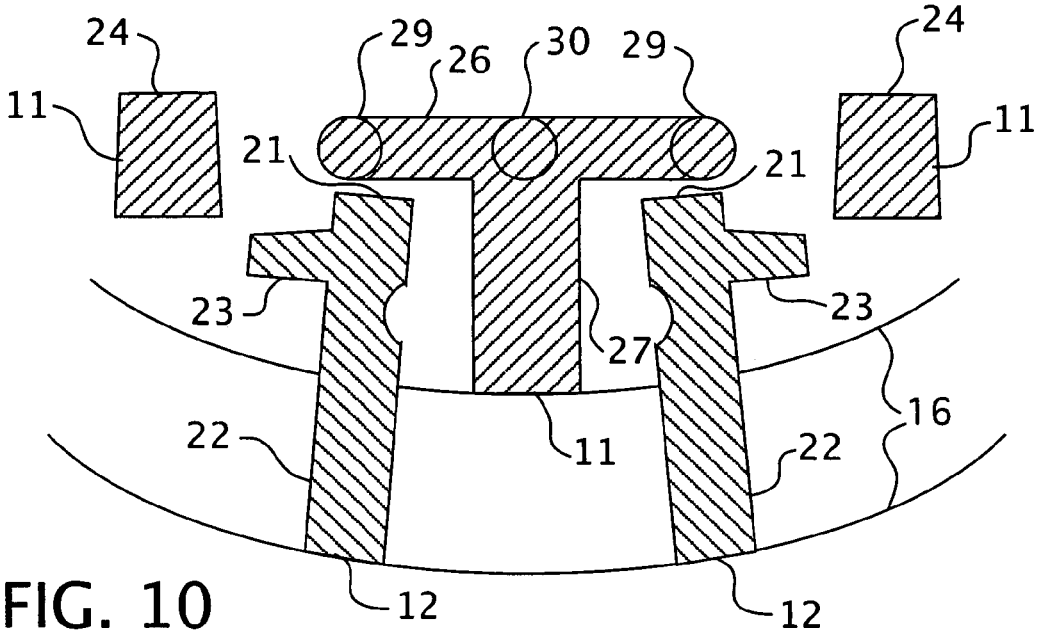

The embodiment schematically illustrated in FIGS. 8,9 and 10 illustrates a variation of the locking means illustrated in FIGS. 5,6 and 7. In this embodiment, two latch mechanisms 21 are maintained in position in a failsafe manner by a single intervening secondary latch mechanism 26 which is double sided having opposite end extensions 29 disposed between the two latch mechanisms 21.

In FIG. 8 the securing means 20 is shown in its failsafe lock position with both helmet portions 11 and 12 secured together at seam 16. Then in FIG. 9, button 30 is depressed inwardly into the figure and into the interior of the helmet through a finger access port as before to provide clearance, and this permits the two latch mechanisms 21 to be flexed inwardly also by ones fingers through a suitable access port or ports as illustrated by the arrows. This permits clearance of the latch mechanisms 21 and permits helmet portion 12 to be pulled away from rear helmet portion 11 as illustrated in FIG. 10 for disengagement.

Figure 11:
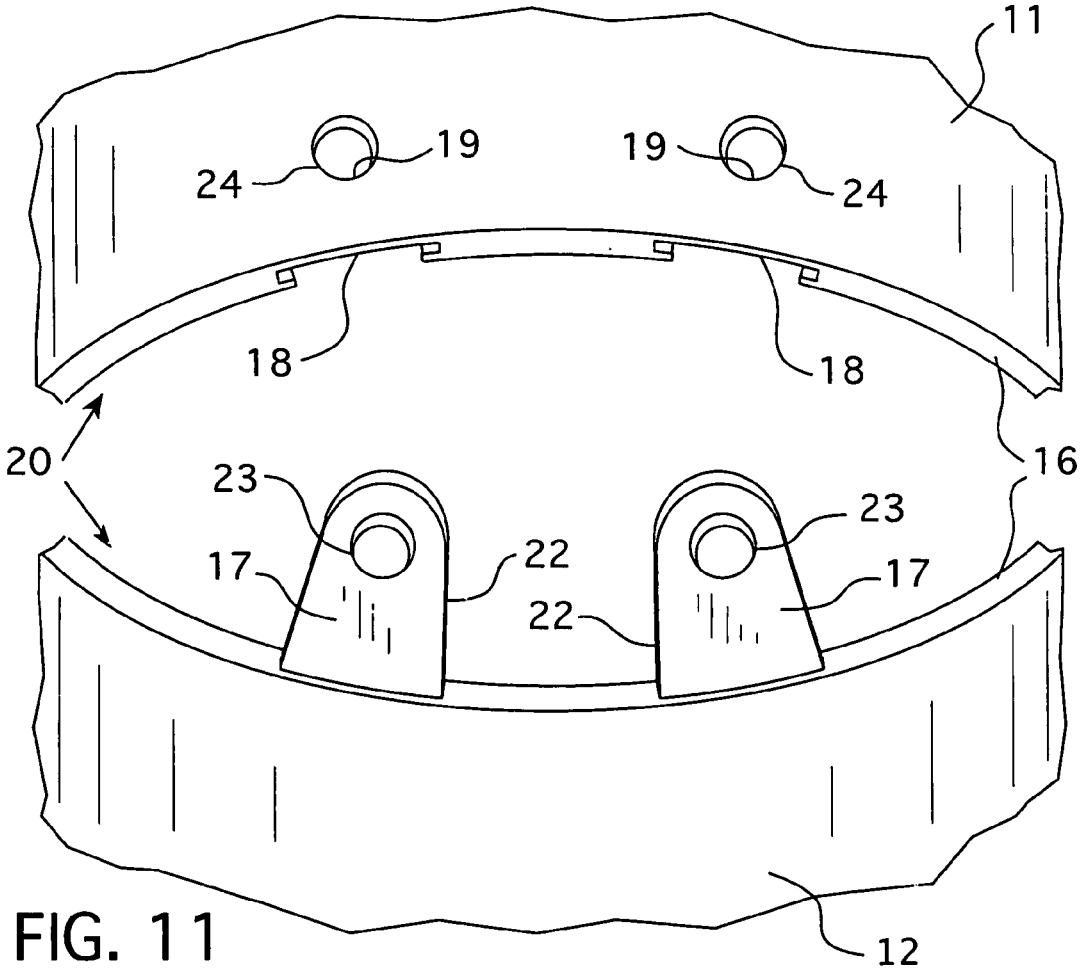
FIG. 11 is an enlarged perspective view showing a portion of the helmet portions disengaged and illustrating yet another embodiment of the securing means for securing the helmet portions together.

Turning next to FIG. 11 yet another embodiment of the securing means or latch mechanism 20 is illustrated wherein the protruding guide lips 17 also function as the flexible stems 22 of the latch mechanisms 21. Also in this embodiment, the protruding latch teeth 23 snap fit into the finger access ports 19 and the finger access ports 19 also provide the corresponding latch keepers 24.

Accordingly, when guide lips 17 with their protruding buttons or teeth 23 are inserted into corresponding recesses 18 of helmet portion 11, and the two helmet portions 11 and 12 are slid together in this guided manner to form a closed seam 16, protruding button teeth 23 will snap in the closed position into the corresponding finger access ports 19 and lock the helmet portions together. When it is decided to disengage the helmet portions 11 and 12, one simply simultaneously presses downwardly onto button teeth 23 through access ports 19 and the helmet portions 11 and 12 are then separated or disengaged.

Figure 13:
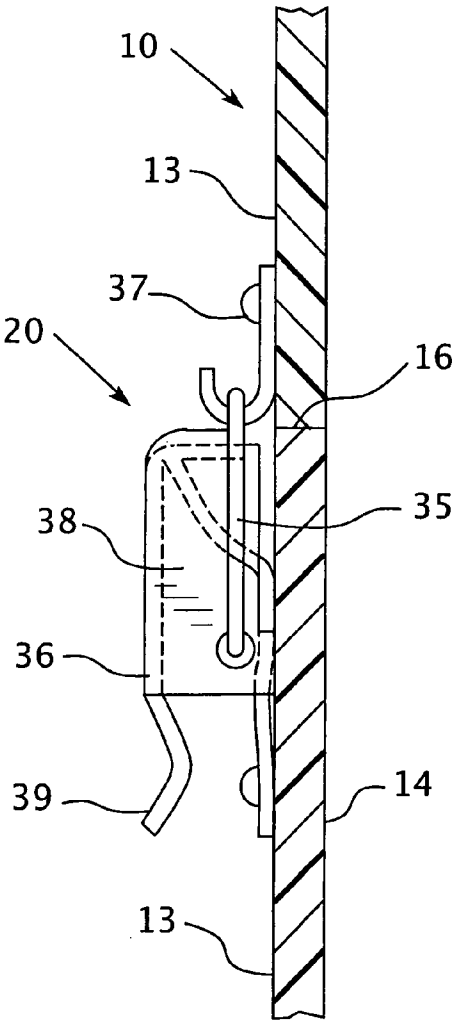
FIG. 13 is a view in side elevation and in partial section of the latch mechanism shown in FIG. 12.
Figure 12:
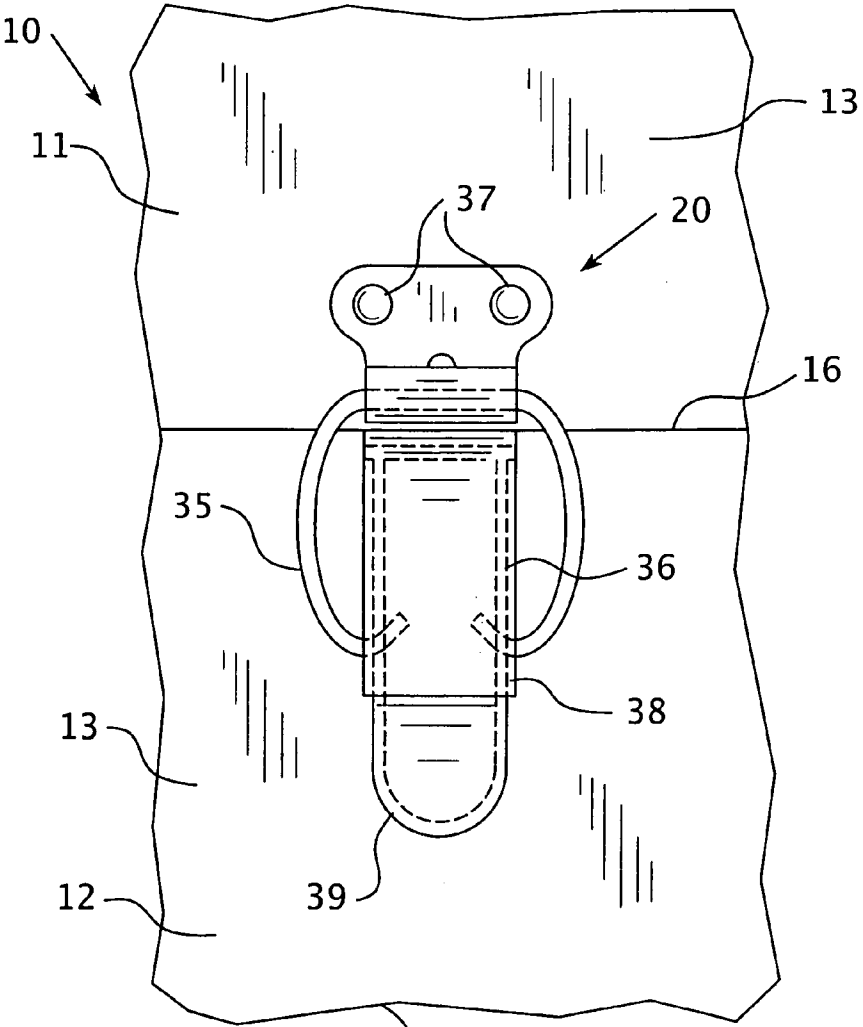
FIG. 12 is a front interior view of yet another embodiment of a latch mechanism or securing means used for securing the two helmet portions together as seen in a segment of the helmet.
Figure 14:
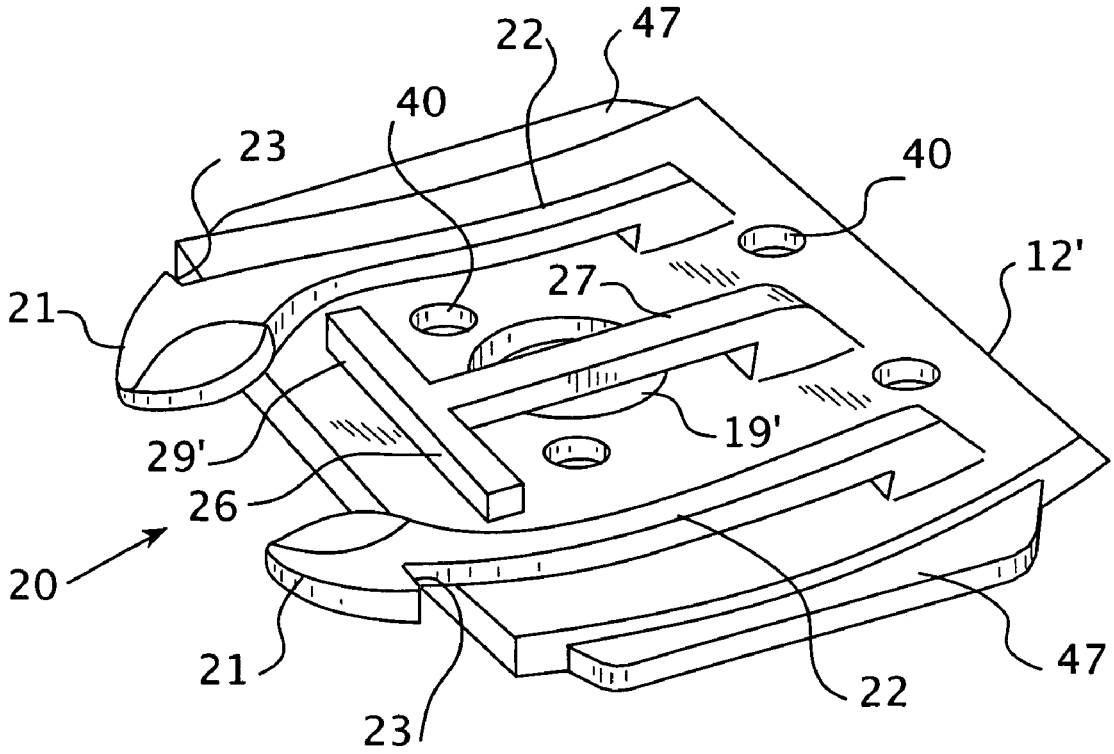
FIG. 14 is a top side enlarged isometric view of another embodiment of the securing means for securing the two helmet portions together.
Figure 15:
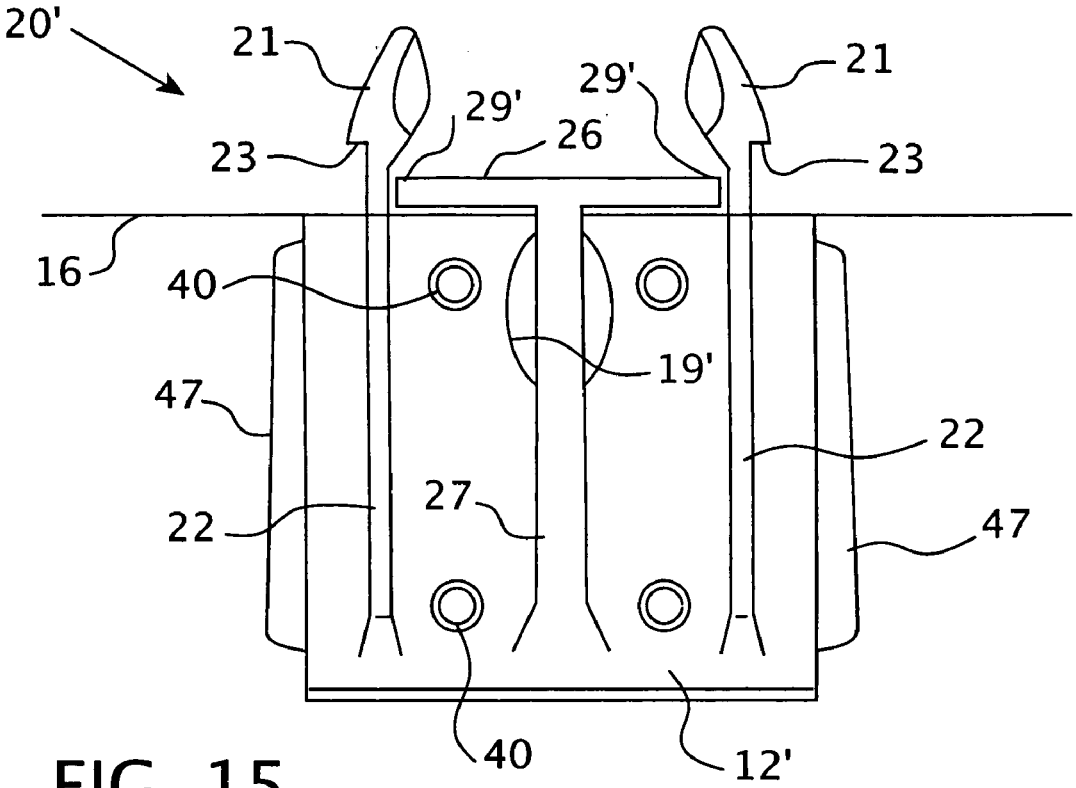
FIG. 15 is a top plan view of the securing means shown in FIG. 14.
Figure 16:
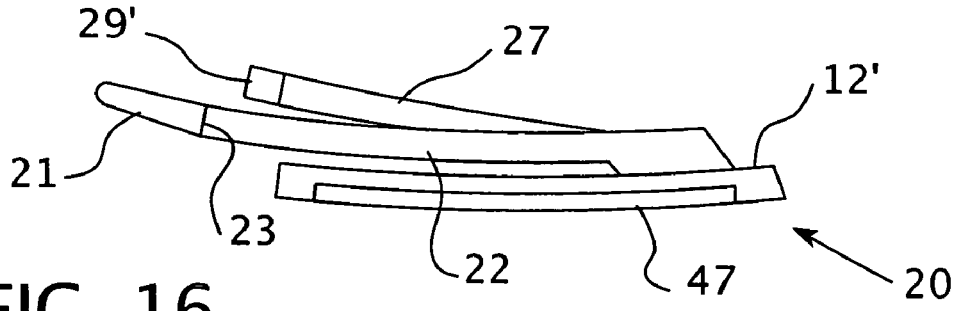
FIG. 16 is a left side view of the securing means shown in FIG. 15 with the center T-bar failsafe lock shown in a flexed position.
Figure 17:
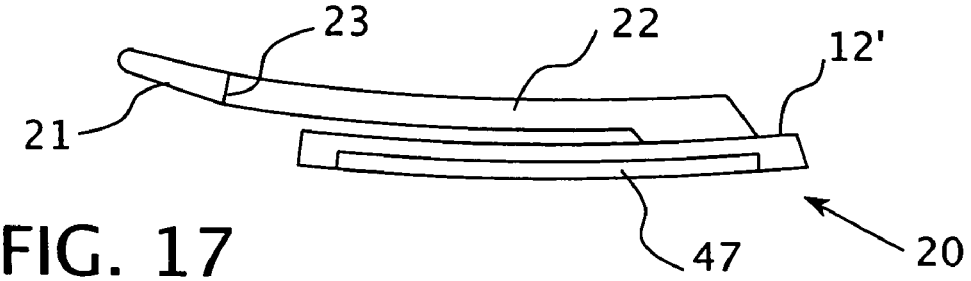
FIG. 17 is a left end view of the securing means shown in FIG. 15 with the centered T-bar shown in a relaxed position.
Figure 18:
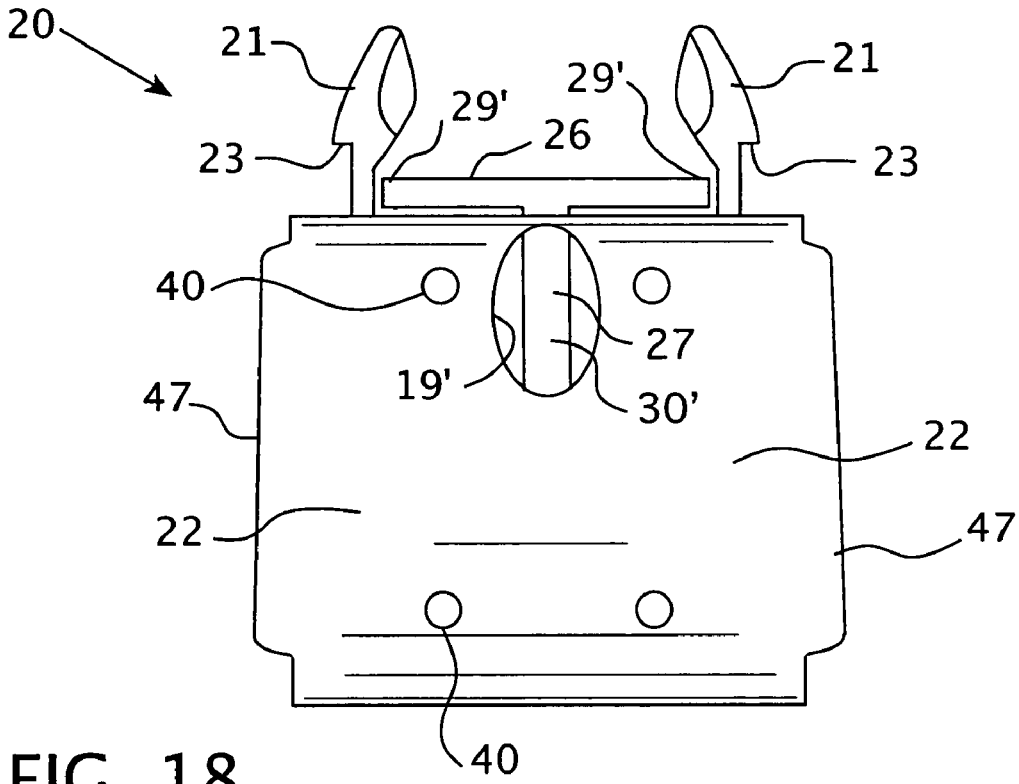
FIG. 18, is a bottom view of the securing means shown in FIG. 15.
Figure 19:
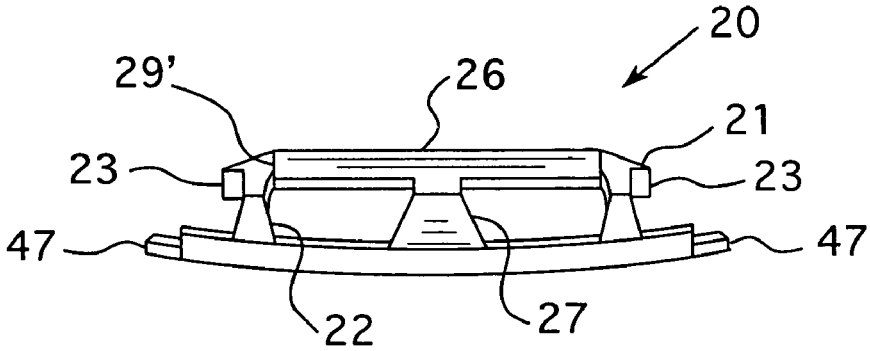
FIG. 19 is a right side end view of the securing means shown in FIG. 16.
Figure 20:
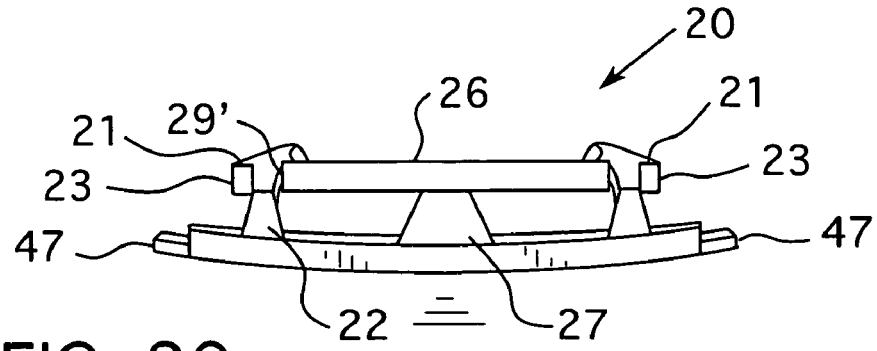
FIG. 20 is a right side end view of the securing means shown in FIG. 17.

FIGS. 12 and 13 illustrate yet another embodiment of the latch mechanism 20. In this embodiment the securing means 20 consists of a conventional cam style latch which is provided with a tensioning bar 35 which applies spring tension to the cam style past dead center latch 36. A catch 37 is provided on the interior portion of helmet portion 11 and the cam latch mechanism 38 is provided with a lift lever 39 which is accessible from the exterior 14 of helmet 10 through finger port access 19. By way of this access lever 39 may be finger depressed inwardly into the interior of the helmet to disconnect the helmet portions 11 and 12. Room for manipulation of the latch mechanism 38 is provided by an opening which is defined in the interior protective padding (not shown) of the helmet.

Referring now to FIGS. 14 through 20, another embodiment of the latch mechanism 20 is illustrated. This embodiment operates in principal identical to the embodiment shown in FIGS. 8, 9 and 10. The primary differences in this embodiment is that the T-bar failsafe securing latch 26 has its flexible stem 27 connected to and flexed from catch body 12' which is the same body portion to which the flex stems 22 of latch mechanisms 21 are also connected to and flexed from.

Figure 21:
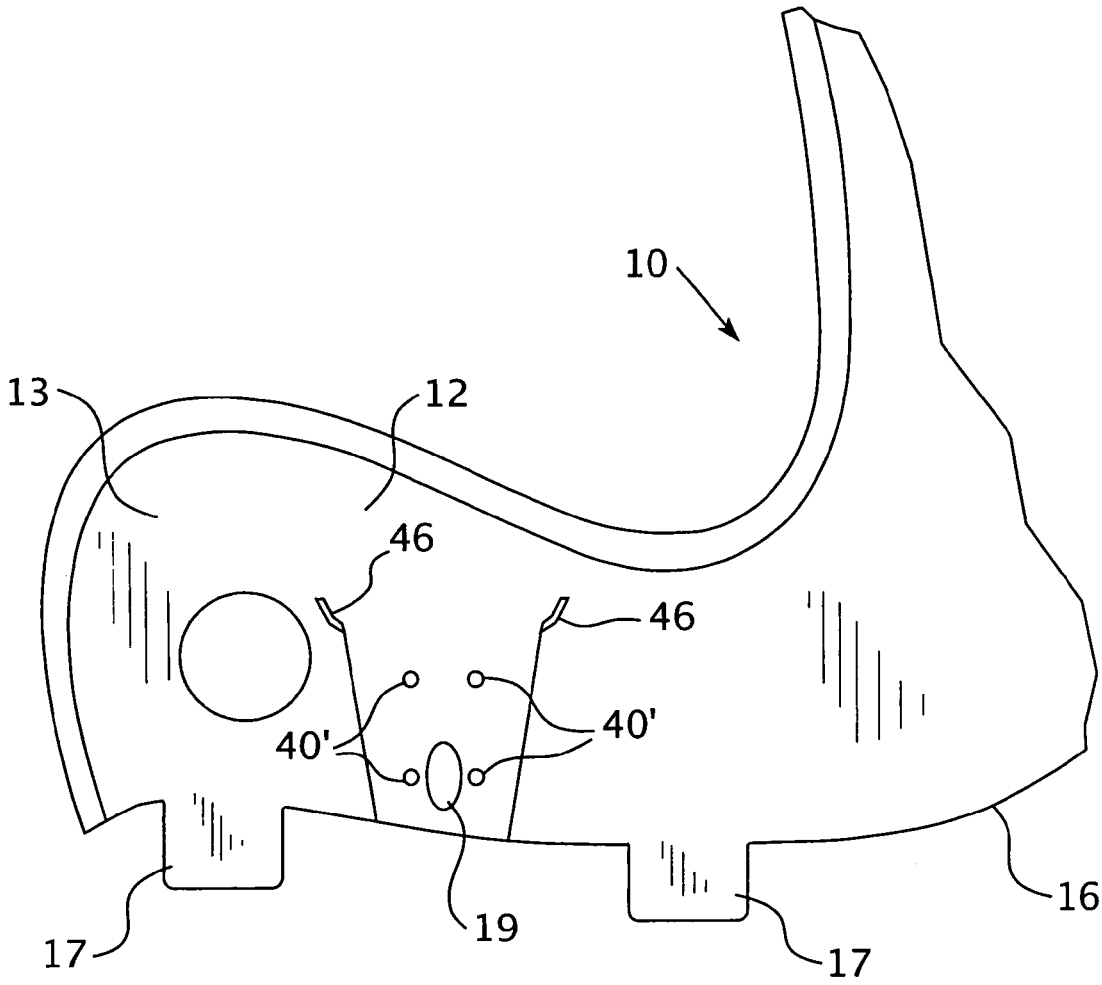
FIG. 21 is an interior perspective view showing a portion of the front part of the two-piece helmet of the present invention illustrating the mounting provided to receive the securing means illustrated in FIGS. 14 through 19.

The entire latch assembly 20' shown may be molded of plastic or formed of metal and the base or body 12' is in turn secured to interior surfaces 13 of helmet portion 12 as seen in FIG. 21 by means of rivets or screws via passages 40. When the body 12' is secured to the helmet portion 12, finger access port 19 of the helmet 10 is aligned with finger access port 19' of catch body 12' so that the flexible stem 27 of T-bar 26 may be engaged from exterior portions 14 of the helmet 10 to engage the portion 30' of stem 27 and flex the same inwardly so that latch mechanisms 21 may be thereafter also simultaneously engaged through other finger access openings from the exterior of the helmet to squeeze them toward each other to disengage the helmet portions 11 and 12 as indicated previously in FIGS. 9 and 10.

With this arrangement the stationary catch 24 is still molded or formed into helmet portion 11 as previously indicated with FIGS. 8,9 and 10, however, the complex flexing members of latch mechanisms 21 and T-bar 26 need not be molded directly into helmet portion 12', or for that matter be molded into either side of the helmet 10 thereby making a less expensive manufacturing process. In FIG. 21, an interior portion of helmet shell portion 12 is illustrated and is prepared for receiving one of the catch body portions 12' described in previous FIGS. 14 through 20. The interior portion 13 of helmet portion 12 is molded with side grooves 46 for slidably receiving downwardly therein in dovetail fashion the dovetail edges 47 of catch body 12' until it is seated therein and wherein access hole 19 is aligned with access port 19' of catch body 12'. Then, as previously described, screws or other suitable fasteners may be applied through holes 40 which now align with corresponding screw passages 40' and helmet shell portion 12. The clear advantage is not only is the helmet less expensive to manufacture but when reconditioning is required catch body 12' may simply be detached and removed from helmet shell portion 12 and a new one inserted in the event that the catch mechanism 20 wears or breaks. In addition, this provides ease and simplicity of manufacture since one catch body 12' will fit helmet shells of all different sizes and styles.

Figure 22:
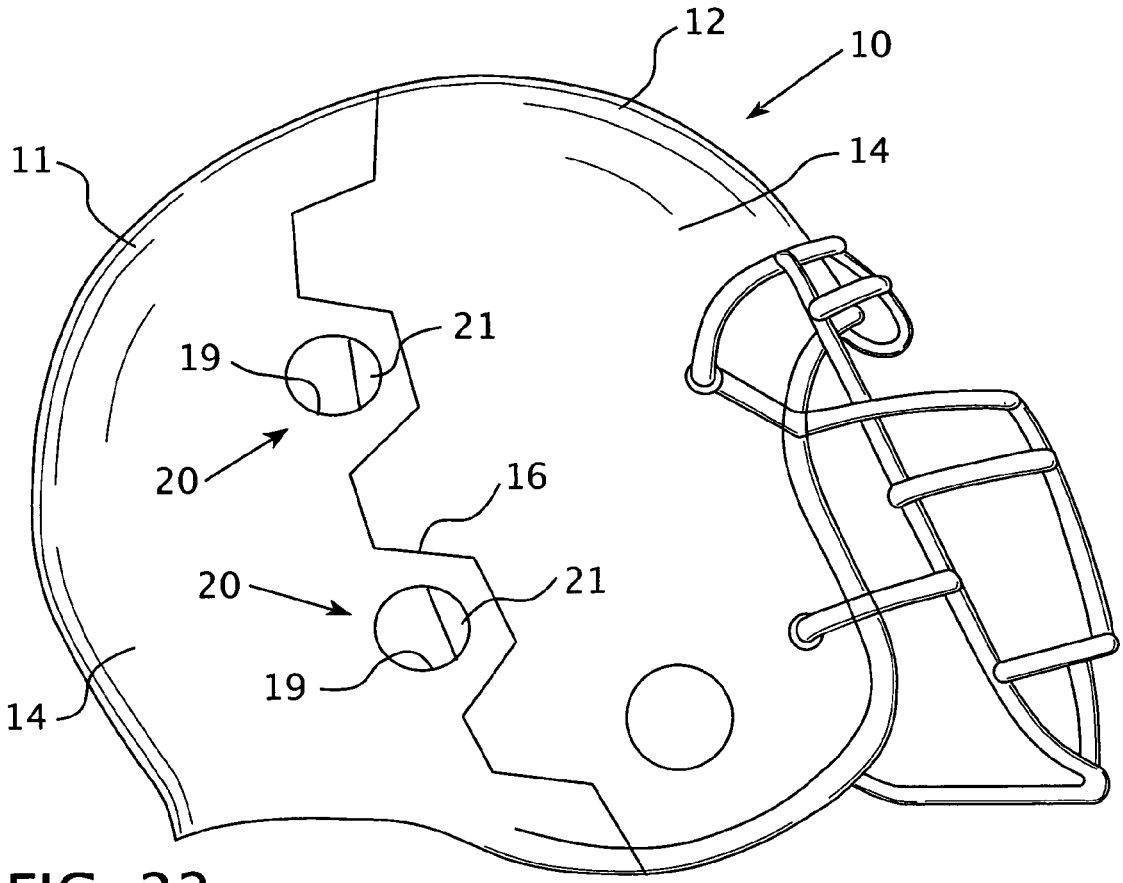
FIG. 22 is a side view of another embodiment of the two-piece helmet of the present invention having a castellated seam therebetween.

FIG. 22 illustrates another embodiment of the multi-piece helmet 10 of the present invention wherein the seam 16 is castellated and FIGS. 23 through 28 represent one embodiment of securing means or latch mechanism 20 for securing the helmet portions 11 and 12 together. As before, like elements are indicated with the same reference numerals used in earlier embodiments.

Figure 23:
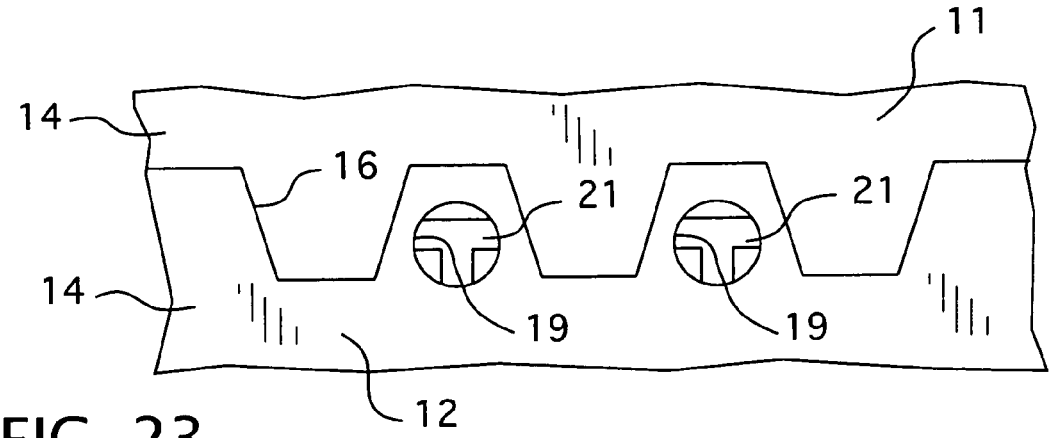
FIG. 23 is an enlarged portion of an exterior portion section of the helmet of the type shown in FIG. 14 along the castellated seam between the helmet halves.
Figure 24:
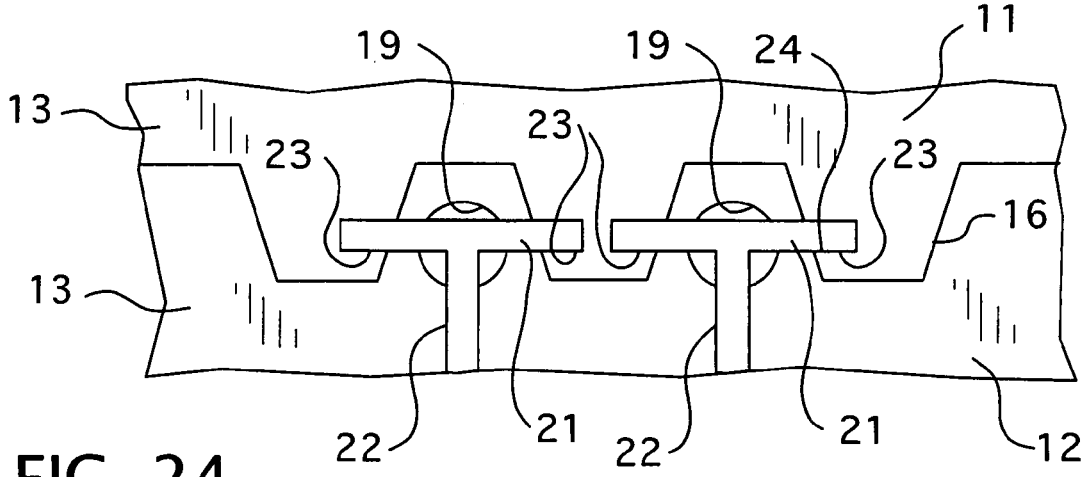
FIG. 24 is an interior view of the helmet portion shown in FIG. 23.

Referring to FIG. 23 an enlarged schematic representation of the seam 16 is represented wherein the finger access ports 19 provide finger access for depressing the catch mechanisms 21 inward to disengage the helmet halves 11 and 12. FIG. 23 shows an interior representation of that which is shown in FIG. 22. The latch mechanisms 21 have flexible stems 22.

In this embodiment, the latch teeth 23 are opposing teeth on opposite sides of the latch mechanism 21 which in this instance is in the form of a T. Bottom portions of flexible stems 22 are flexibly connected to the interior 13 of helmet shell portion 12 so that the T latch mechanisms 21 may be flexed inwardly by depressing them inwardly through the access ports 19. The stationary catches 24 in this embodiment are formed by slots 24 within the interior portions 13 of helmet portion 11.

Figure 25:
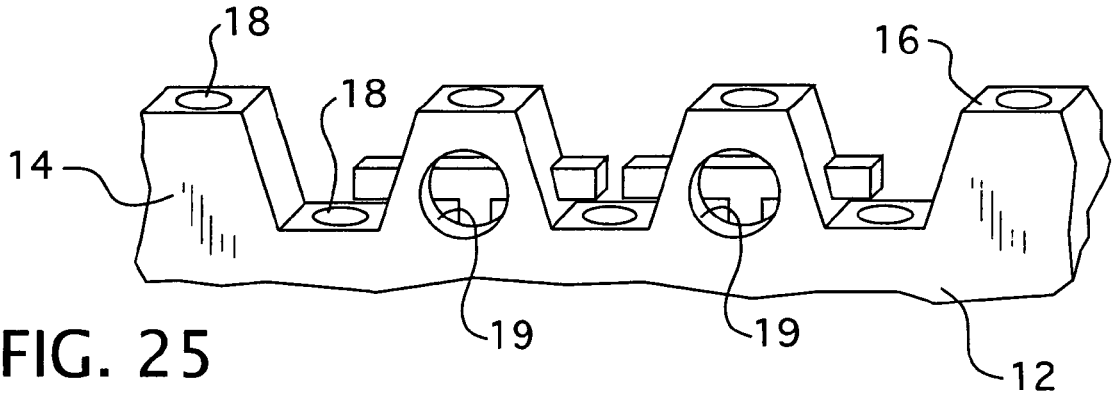
FIG. 25 is an isometric exterior view of one of the helmet portions shown in FIGS. 23 and 24 with the helmet portions disengaged.
Figure 26:
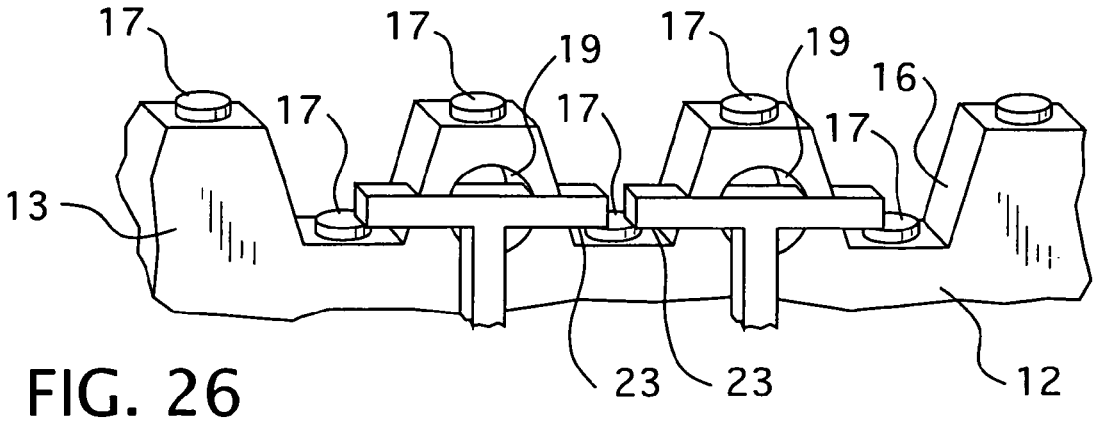
FIG. 26 is an isometric interior view of the helmet portion structure shown in FIG. 25 illustrating a variation in the inter-protruding guide elements which aline the helmet portions together along their seam.

In order to hold the helmet halves in proper alignment along castellated seam 16, guide recesses 18 seen in FIG. 25 and guide protrusions 17 as seen in FIG. 26, are provided along seam 16 on opposite edges of the helmet portions 11 and 12. In FIG. 25 the recesses 18 are provided in helmet shell portion 12. Correspondingly then the corresponding guide protrusions 17 would be provided in the edge along seam 16 of the other helmet shell portion 11. To the contrary, in FIG. 26, the guide protrusions 17 are shown to be positioned along seam 16 in the edge of helmet shell portion 12. Correspondingly then the corresponding recesses 18 in this version would then be provided along the edge of the seam 16 in the other helmet shell portion 11.

Figure 27:
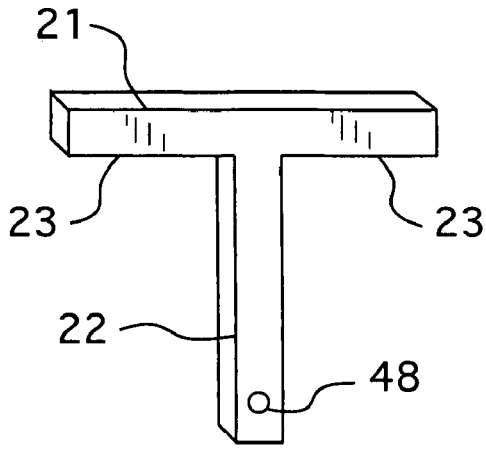
FIG. 27 is an isometric view illustrating one of the T-flex brackets used in the structures of FIGS. 15 through 18.
Figure 28:
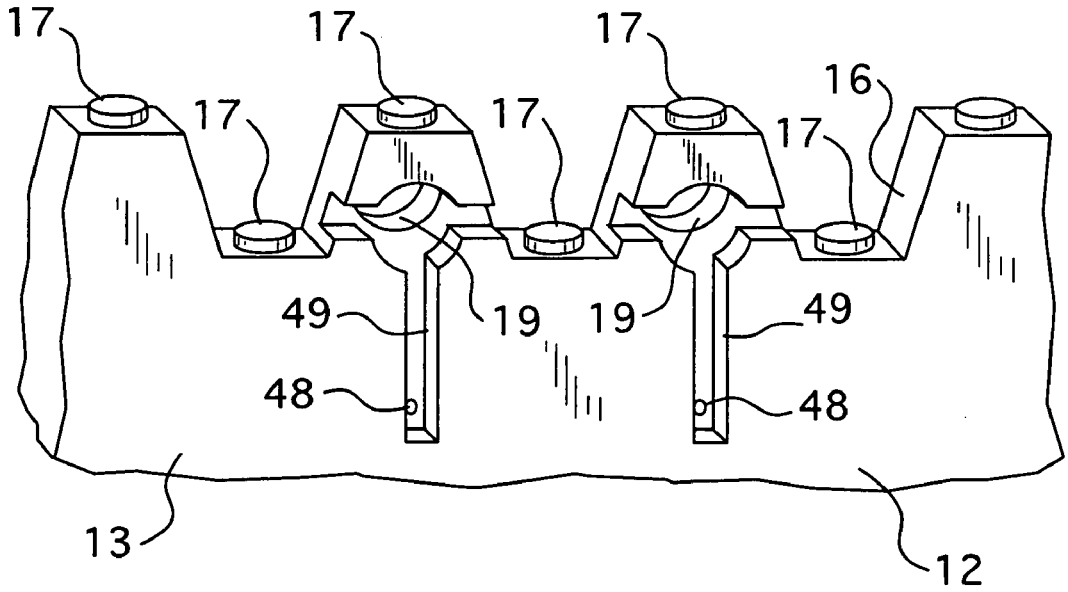
FIG. 28 is an interior view of the one portion of the helmet structure shown in FIG. 26 with the flex T-brackets of FIG. 27 removed.

The T-shaped latch mechanisms 21 may be manufactured or provided separately as indicated in FIG. 27 and then secured with an appropriate screw or other fastener through fastener passage 48 which secures the base end of flexible stem 22 to the interior of helmet shell portion 12 via screw passages 48' as indicated in FIG. 28 wherein the T-shaped latch mechauisms 21 are recessed in or received in corresponding T-slots 49. In this manner if any one of the flexible stems 22 should happen to break from excess flexing they can be easily replaced.

Figure 29:
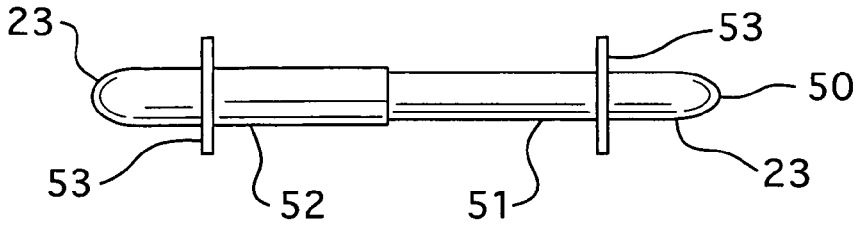
FIG. 29 is a view in front elevation of a telescoping dead pin used in the latch mechanism or securing means illustrated in FIGS. 30 and 31.
Figure 30:
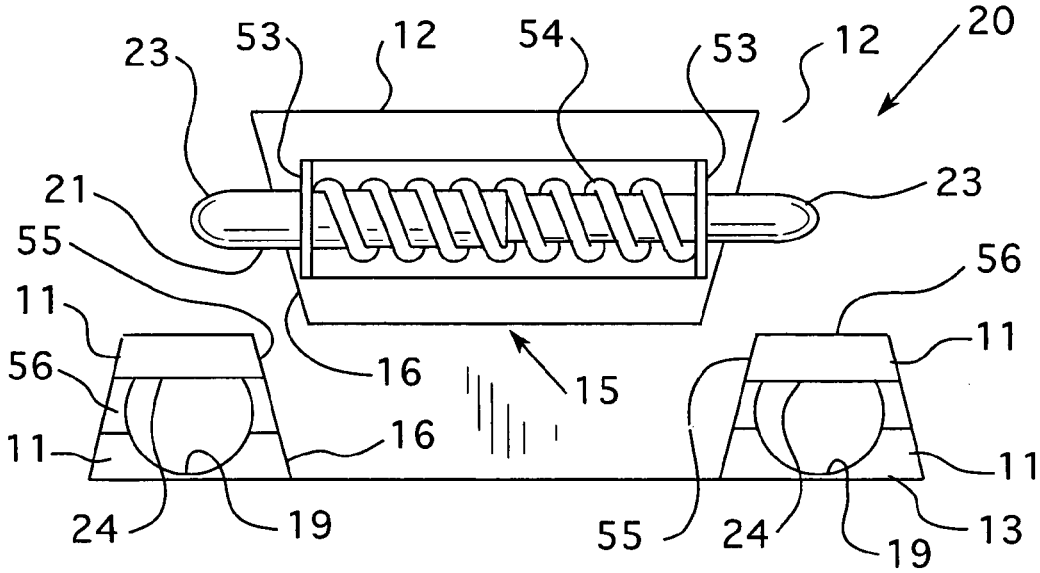
FIG. 30 is a schematic representation of the two helmet portions of the helmet shell structure shown in FIG. 22 separated and incorporating the completed latch mechanism shown in FIG. 29 just prior to engagement of the helmet portions.
Figure 31:
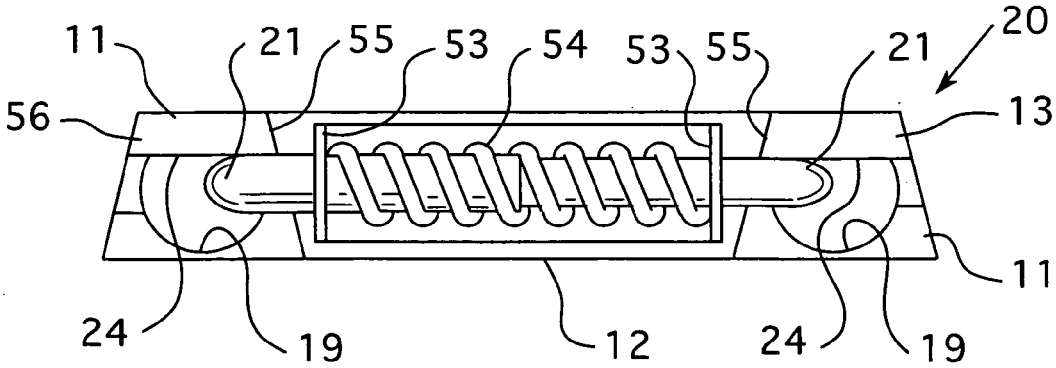
FIG. 31 is a schematic representation of the securing means shown in FIG. 30 in the closed or secured position with the helmet portions locked or secured together.

FIGS. 29, 30 and 31 schematically represent yet another type of fastening device or securing means 20 which may be utilized to secure the helmet shell portions 11 and 12 together as seen in FIG. 12 along castellated seam 16 in accordance with the teachings of the present invention.

Referring first to FIG. 29, a telescoping dead pin 50 is provided wherein right side pin portion 51 is telescopically received within the tubular interior of left side pin portion 52. The two pin portions 51 and 52 are also provided with annular spring keepers 53 for engagement therebetween and confinement of compression spring 54 as seen in FIG. 30. The opposite ends of dead pin 50 provide usual protruding latch teeth 23 for the latch mechanism 21.

The spring bias telescoping dead pins 50 are retained within protruding guide portions 15 of the castellated seam 16 in the front helmet shell portion 12. Thus, when the two separated helmet portions 11 and 12 are engaged with each other to close seam 16, the catch teeth 23 of telescoping pin 50 engage the slope surfaces 55 of the corresponding protrusions 15 along seam 16 of helmet shell portion 11 to thereby compress pin 50 telescopically inward so that the two end teeth 23 depress inwardly under the compression of spring 54 until they reach the corresponding latch passages which provide catches 24 in the protrusions 56 of helmet shell portion 11. At this point the dead pin 50 will expand outwardly at both end teeth 23 to engage the interiors of the passage latch 24 by securing the helmet portions 11 and 12 together. Finger access ports 19 provide access from the exterior portions of the helmet shell to permit engagement and inward compression of the protruding teeth 23 for disengagement of the helmet shell portions 11 and 12.

Figure 32:
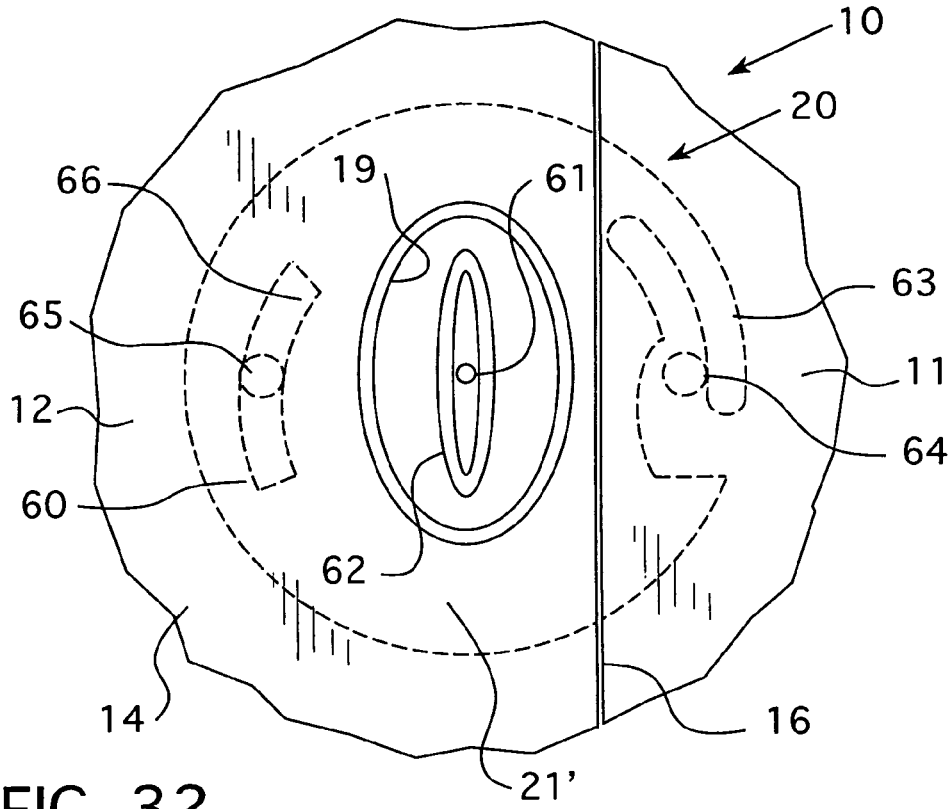
FIG. 32 is an enlarged schematic representation of yet another embodiment of the securing mechanism used to lock the helmet halves together and shown in its locked position.
Figure 33:
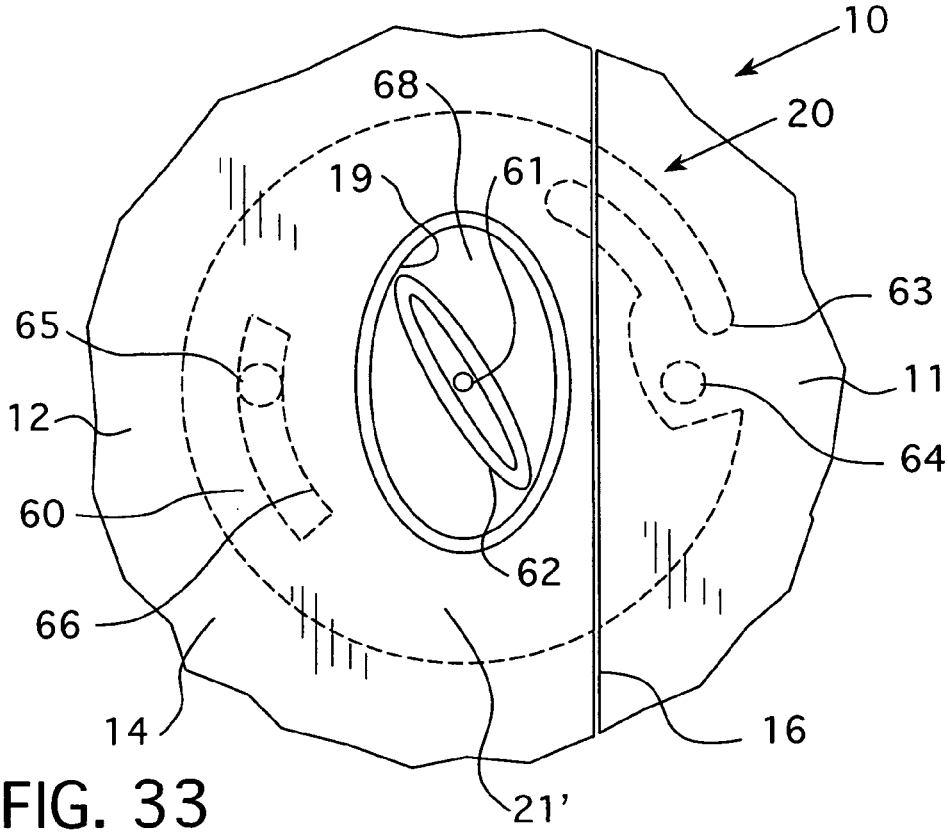
FIG. 33 is an enlarged schematic representation of the locking mechanism shown in FIG. 32 in the open or unlocked position whereby the helmet halves may be separated or disengaged from each other.

Referring next to FIGS. 32 and 33, yet another securing means 20 is illustrated schematically from the helmet exterior 14 which secures the helmet shell portions 11 and 12 together with a rotating lock mechanism 21 shown in dashed outline. In this arrangement a latch disk 60 is rotatable about pivot point 61 by means of handle 62 which is accessible from the exterior of the helmet 10 through finger access port 19 for rotation of handle 62 and corresponding rotation of disk 60.

In FIG. 32, helmet shell portions 11 and 12 are securely locked together along seam 16 by interlocking of latch arm 63 which has engaged catch peg 64. Latch disk 60 is retained pivotally centered by means of guide pin 65 which extends through guide slot 66 of disk 60 from helmet portion 12 and has an enlarged head 66 which retains disk 60 in place and retains handle 62 together with its surrounding circular protrusion area 68 centered in and pivotally received within the annular confines of finger access port 19. FIG. 33 represents the helmet 10 in its disengaged position whereby helmet shell portions 11 and 12 may be disengaged as latch arm 63 is disengaged from catch peg 64.

Figure 34:
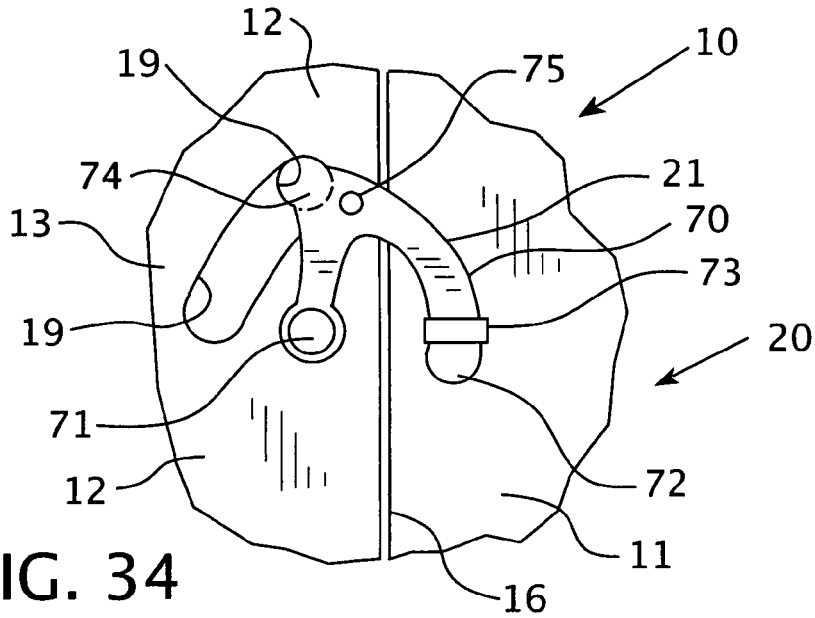
FIG. 34 illustrates an additional embodiment of the locking mechanism which may be employed to lock or secure the helmet portions together and illustrates the helmet portions in a secured locked together position.
Figure 35:
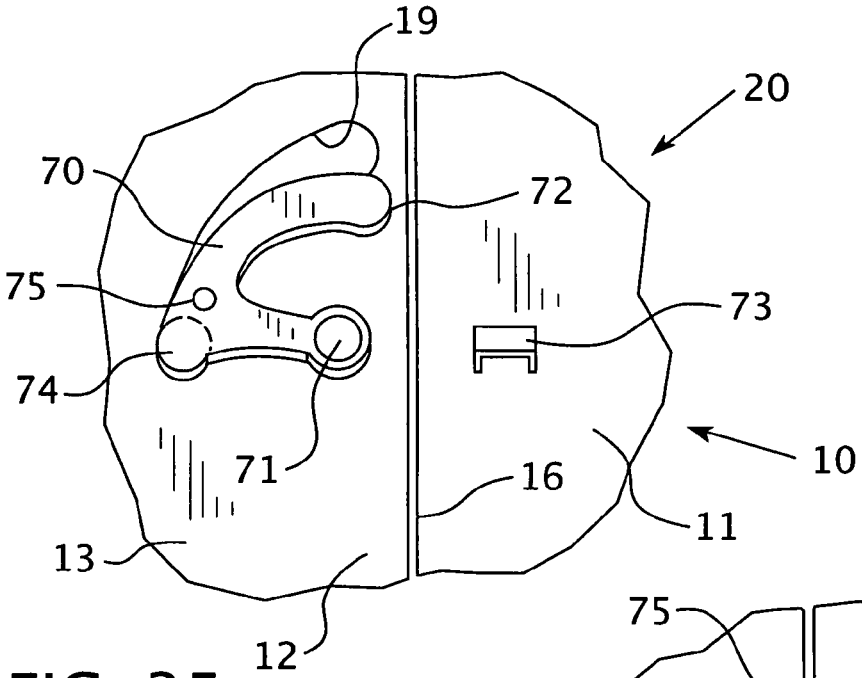
FIG. 35 is a schematic representation of the securing mechanism shown in FIG. 34 in an unlocked position whereby the helmet portions may be disengaged.
Figure 36:
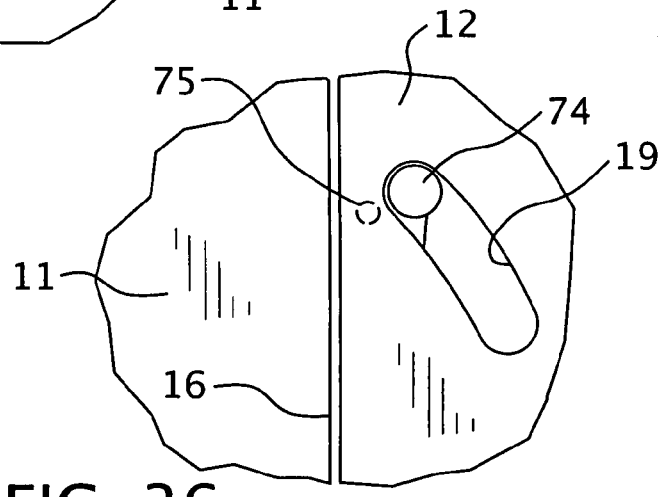
FIG. 36 is an exterior view of the locking mechanism shown in FIGS. 34 and 35 as shown in its locked position.

FIGS. 34,35 and 36 schematically represent yet another pivotal connecting mechanism 20 as seen from interior portions 13 of helmet 10. In this mechanism latch arm 70 is rotatably pivotal about pivot 71 which is pivotally secure to the interior surfaces of 13 of helmet portion 12. The locking mechanism 21 is illustrated in its locked position in FIG. 34 wherein the distal end 72 is rotatably and slidably received in catch arm 73 thereby locking the helmet shell portions 11 and 12 securely together along seam 16.

To disengage the helmet portions 11 and 12, one depresses and accesses latch button 74 from exterior portions of the helmet 10 via finger access port 19. The button 74 is depressed inwardly which causes locking pin 75 to disengage from a corresponding interior recess within the interiors 13 of helmet portion 12 thereby permitting the attendant to further rotate latch arm 60 about pivot 71 via access through finger access port 19 for disengagement to the unlocked position illustrated in FIG. 35. As is best illustrated in FIG. 36, finger access port 19 is oblong so that button 74 be accessed and depressed inwardly to disengage locking pin 75 from its corresponding recess and to thereafter further rotate button 74 downwardly as seen in the figure to rotate latch arm 70 to thereby disengage the same from catch 73.

I claim:

1. A multiple-piece helmet for protecting a head region of the wearer and providing emergency removal, said helmet comprising:

a rigid rear helmet portion;

a separate rigid front helmet portion;

said helmet portions having interior and exterior surfaces and inter-protruding guide means for aligning said helmet portions together along a seam therebetween;

securing means extending between said helmet portions and holding said portions together in a releasable manner;

said securing means positioned on said interior surfaces, and finger access ports in said helmet for providing finger access to said securing means from said exterior surfaces whereby said securing means may be finger manipulated for thereby releasing said securing means and completely separating said front helmet portion from said rear helmet portion without requirement of a tool;

said securing means including multiple snap-fit finger latches, each having a flexible stem secured at a proximal end thereof to the interior surfaces of one of said helmet portions, and a latch tooth laterally protruding from a distal end of each of said stems and received in a corresponding latch recess in the interior surfaces of the other of said helmet portions, said ports positioned whereby said stems may be engaged through respective ports from said exterior surfaces by ones fingers for thereby flexing said stems to disengage said latch teeth from their respective latch recesses for separating said front helmet portion from said rear helmet portion.

2. The multiple-piece helmet of claim 1, said securing means including a rotatable latch mechanism having a securing protrusion which protrudes into a corresponding depression in said interior surfaces and said latch mechanism is accessible from said exterior surfaces for depression thereof to thereby disengage said protrusion from said depression to release said latch mechanism for release rotation.

3. The multiple-piece helmet of claim 1, including displaceable safety lock means positioned to block said finger latch stems from flexing and thereby accidentally disengaging.

4. The multiple-piece helmet of claim 1, wherein said helmet seam has a castellated tooth configuration providing inter-engaging teeth therealong, said latch recesses provided in interior surfaces of said castellated teeth.

5. The multiple-piece helmet of claim 1, wherein said flexible stems are secured at their proximal ends to a respective base which is detachably secured to said interior surfaces of said one helmet portion.

* * * * *